US008711539B2

(12) United States Patent
Inoue et al.

(10) Patent No.: US 8,711,539 B2
(45) Date of Patent: Apr. 29, 2014

(54) SWITCHGEAR OPERATING APPARATUS AND THREE-PHASE SWITCHGEAR

(75) Inventors: Takakazu Inoue, Tokyo (JP); Yasushi Takeuchi, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 74 days.

(21) Appl. No.: 13/144,520

(22) PCT Filed: Mar. 31, 2010

(86) PCT No.: PCT/JP2010/002359

§ 371 (c)(1),
(2), (4) Date: Jul. 14, 2011

(87) PCT Pub. No.: WO2010/113500

PCT Pub. Date: Oct. 7, 2010

(65) Prior Publication Data

US 2011/0267734 A1 Nov. 3, 2011

(30) Foreign Application Priority Data

Apr. 2, 2009 (JP) ..... 2009-089663

(51) Int. Cl.

| | |
|---|---|
| ***H01H 9/00*** | (2006.01) |
| ***H01H 47/00*** | (2006.01) |
| ***H01H 51/22*** | (2006.01) |
| ***H01H 51/30*** | (2006.01) |

(52) U.S. Cl.
USPC ..... 361/160

(58) Field of Classification Search
USPC ..... 361/160
See application file for complete search history.

(56) References Cited

U.S. PATENT DOCUMENTS

| | | | | |
|---|---|---|---|---|
| 5,449,157 | A * | 9/1995 | Kawano et al. | 270/58.11 |
| 5,499,157 | A * | 3/1996 | Younessi et al. | 361/191 |
| 5,572,142 | A | 11/1996 | Muraki | |
| 6,713,979 | B2 * | 3/2004 | Naito et al. | 318/280 |
| 7,787,228 | B2 * | 8/2010 | Koyama et al. | 361/78 |
| 7,872,846 | B2 * | 1/2011 | Titschert et al. | 361/166 |
| 2003/0020420 | A1 | 1/2003 | Naito et al. | |

FOREIGN PATENT DOCUMENTS

| | | |
|---|---|---|
| CN | 1405970 A | 3/2003 |
| DE | 9320915 | 6/1995 |
| DE | 10 2007 054 860 | 6/2008 |
| JP | 7-301655 A | 11/1995 |

(Continued)

OTHER PUBLICATIONS

English machine translated document of JP 2000-184582 A.*

(Continued)

*Primary Examiner* — Stephen W Jackson
*Assistant Examiner* — Rasem Mourad
(74) *Attorney, Agent, or Firm* — Buchanan Ingersoll & Rooney PC

(57) ABSTRACT

A switchgear operating apparatus provided with an electronic switching device (7) connected to a negative electrode side of a DC power supply and a plurality of operating coils (4) which are simultaneously energized and controlled by the electronic switching device (7) for performing on/off operations of a three-phase switchgear includes diodes (6*a*, 6*b*, 6*c*) connected between the individual operating coils (4) and the electronic switching device (7), and a voltage detector (9) for detecting potential differences applied to the individual diodes (6*a*, 6*b*, 6*c*) and the electronic switching device (7).

15 Claims, 1 Drawing Sheet

(56) References Cited

FOREIGN PATENT DOCUMENTS

| | | | |
|---|---|---|---|
| JP | 9-092100 | A | 4/1997 |
| JP | 2000-184582 | A | 6/2000 |
| JP | 2003-016887 | A | 1/2003 |
| JP | 2006-004902 | A | 1/2006 |

OTHER PUBLICATIONS

English machine translation Hiroshi (JP 2000-184582).*
International Search Report (PCT/ISA/210) for PCT/JP2010/002359 dated Apr. 27, 2010.
Korean Office Action, with English-langauge translation, dated Jul. 24, 2012.
Chinese Office Action dated Apr. 23, 2013, of the corresponding Chinese Patent App. No. CN 201080004847.7, and a partial English translation thereof (14 pages).
German Office Action dated May 16, 2013, of the corresponding German Patent App. No. 11 2010 001 507.4, and English translation thereof (8 pages).
Chinese Office Action for corresponding Chinese Appin. No. 201080004847.7 dated Nov. 27, 2013, with English-language translation (14 pages).

* cited by examiner

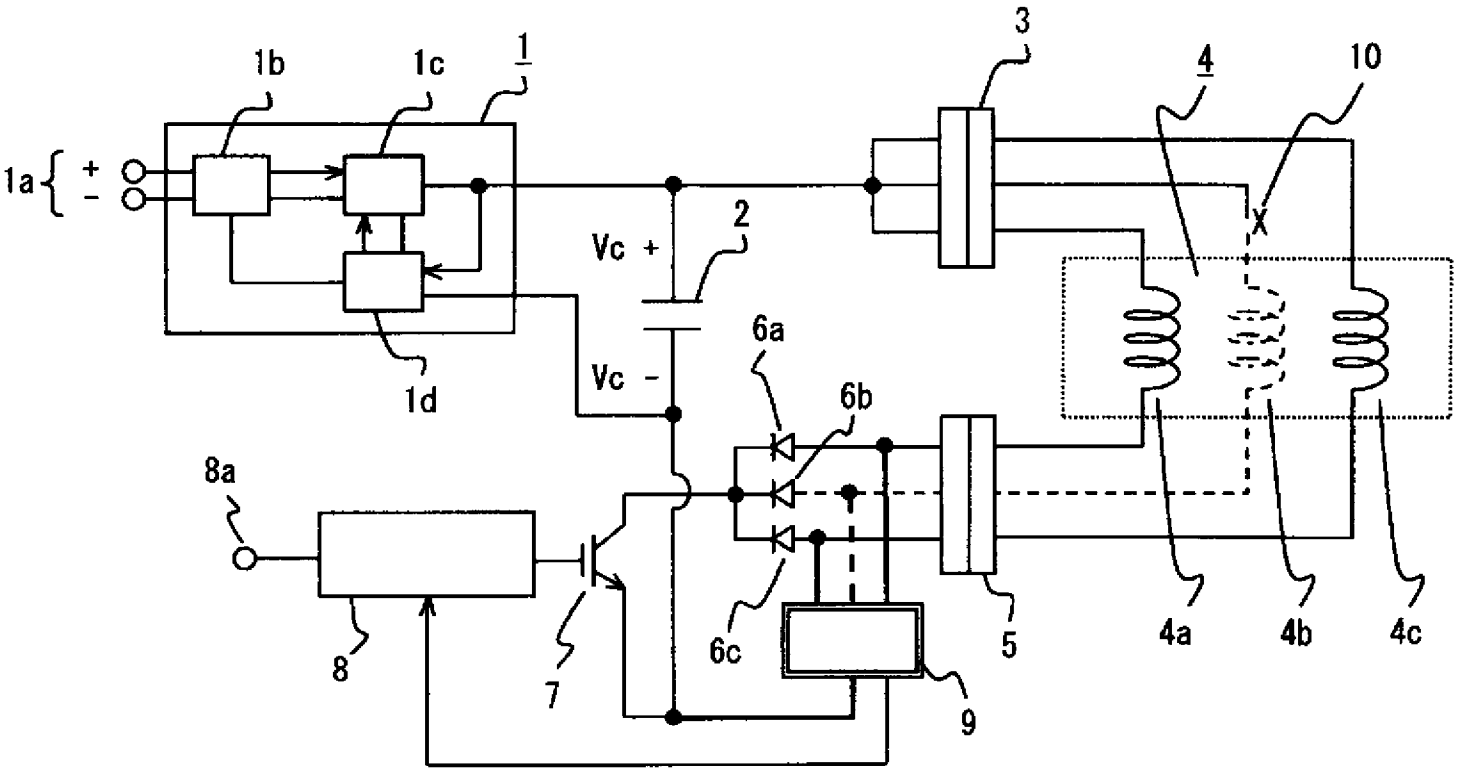
10
4
3
4c
4b
4a
5
9
6b
6a
6c
2
Vc +
Vc -
7
1
1c
1d
1b
8
8a
1a
+
-

SWITCHGEAR OPERATING APPARATUS AND THREE-PHASE SWITCHGEAR

TECHNICAL FIELD

The present invention relates to a switchgear operating apparatus having coils for performing on/off operations of a switchgear and a three-phase switchgear and, in particular, the invention is concerned with detection of a circuit disconnection.

BACKGROUND ART

A conventional switchgear operating apparatus for performing on/off operations of a switchgear by means of coils is configured with the coils for driving main circuit on/off devices (e.g., vacuum switch valves) to open and close, a power supply for feeding electric power to the coils and a switch for controlling delivery of power to the coils. The coils are energized when the switch is closed, whereby the switchgear is driven to open or close (refer to Patent Document 1, for example).

PRIOR ART DOCUMENT

Patent Document

Patent Document 1: Japanese Patent Application Publication No. 2003-16887

SUMMARY OF THE INVENTION

Problems to be Solved by the Invention

A conventional switchgear operating apparatus in which a switchgear is directly driven by coils in operation is not provided with any means for detecting the occurrence of a circuit disconnection in case the same occurs in a driving circuit including a power supply, a switch and coils. For this reason, there has been a problem that one would notice the occurrence of the circuit disconnection in the driving circuit only after the occurrence of an operational error in an opening or closing operation performed after the occurrence of the circuit disconnection.

The present invention has been made to solve the aforementioned problem. Accordingly, it is an object of the invention to provide a switchgear operating apparatus and a three-phase switchgear that can detect an abnormal situation which may occur when preventing an incomplete opening or closing operation, for example, in the event of a circuit disconnection in a driving circuit or in the event of a circuit disconnection in one phase among three phases.

Means for Solving the Problems

The present invention provides a switchgear operating apparatus provided with switching means connected to a negative electrode side of a DC power supply and a plurality of operating coils which are simultaneously energized and controlled by the switching means for performing on/off operations of a three-phase switchgear, the switchgear operating apparatus including rectifying devices connected between the individual operating coils and the switching means, and detection means for detecting potential differences applied to the individual rectifying devices and the switching means.

The present invention also provides a three-phase switchgear including a switchgear operating apparatus provided with switching means connected to a negative electrode side of a DC power supply and a plurality of operating coils which are simultaneously energized and controlled by the switching means for performing on/off operations of the three-phase switchgear, the switchgear operating apparatus including rectifying devices connected between the individual operating coils and the switching means, and detection means for detecting potential differences applied to the individual rectifying devices and the switching means.

Advantageous Effects of the Invention

A switchgear operating apparatus according to the present invention is provided with switching means connected to a negative electrode side of a DC power supply and a plurality of operating coils which are simultaneously energized and controlled by the switching means for performing on/off operations of a three-phase switchgear, the switchgear operating apparatus including rectifying devices connected between the individual operating coils and the switching means, and detection means for detecting potential differences applied to the individual rectifying devices and the switching means. It is therefore possible to detect a wide range of anomalies caused by a circuit disconnection, for example.

A three-phase switchgear according to the present invention includes a switchgear operating apparatus provided with switching means connected to a negative electrode side of a DC power supply and a plurality of operating coils which are simultaneously energized and controlled by the switching means for performing on/off operations of the three-phase switchgear, the switchgear operating apparatus including rectifying devices connected between the individual operating coils and the switching means, and detection means for detecting potential differences applied to the individual rectifying devices and the switching means. It is therefore possible to detect a wide range of anomalies caused by a circuit disconnection, for example.

BRIEF DESCRIPTION OF THE DRAWING

FIG. 1 is a diagram depicting the configuration of a switchgear operating apparatus according to a first embodiment of the present invention.

MODE OF CARRYING OUT THE INVENTION

First Embodiment

A mode of carrying out the present invention is described hereinbelow. FIG. 1 is a diagram depicting the configuration of a switchgear operating apparatus according to a first embodiment of the invention. The switchgear operating apparatus of the first embodiment which is provided with a driving circuit configured with a power supply, operating coils and a driving switch is for performing on/off operations of a three-phase switchgear. Referring to the FIGURE, the switchgear operating apparatus includes a charging circuit section 1 connected to power input terminals 1*a*, a capacitor 2 for storing electric power that serves as a DC power supply connected to the charging circuit section 1, an electronic switching device 7 that serves as switching means connected to a negative electrode side of the capacitor 2, operating coils 4*a*, 4*b*, 4*c* for each of three phases that are simultaneously energized and controlled by the electronic switching device 7, diodes 6*a*, 6*b*, 6*c* that are connected between the individual operating coils 4*a*, 4*b*, 4*c* and the electronic switching device 7, respectively, to serve as rectifying devices for separating the three phases from one another, a first connector 3 for connecting a positive electrode side of the capacitor 2 to the individual operating coils 4*a*, 4*b*, 4*c* and a second connector 5 for connecting the operating coils 4*a*, 4*b*, 4*c* to the respective diodes 6*a*, 6*b*, 6*c*. The charging circuit section 1 includes a noise filter 1*b* that blocks external noise and overvoltage to prevent misoperation and breakage, a DC-DC converter 1*c* that converts an input voltage into a voltage at which the capacitor 2 is charged, and a voltage monitoring circuit 1*d* that monitors the amount of electric charge charged into the capacitor 2 in terms of a voltage and feeds back this voltage for regulating an output of the DC-DC converter 1*c*.

The switchgear operating apparatus of FIG. 1 also includes a switching controller 8 for controlling the electronic switching device 7, an input terminal 8*a* through which a command signal is input into the switching controller 8, and a voltage detector 9 that serves as detection means which detects potential differences applied to the individual diodes 6*a*, 6*b*, 6*c* and the electronic switching device 7 and, upon detecting that a detected voltage differs from a specified value, outputs an anomaly detection signal on the assumption that an abnormal situation has occurred. It is to be noted that the "specified value" mentioned above refers to a voltage value or a range of voltage values that should normally be detected. Also, the switchgear operating apparatus may be configured such that electric power for driving the voltage detector 9 is supplied from the capacitor 2.

Described below is how an anomaly is detected by the switchgear operating apparatus of the first embodiment configured as mentioned above. First, the voltage detector 9 monitors voltages of circuits of the individual phases by detecting potential differences applied to the individual diodes 6*a*, 6*b*, 6*c* and the electronic switching device 7. Then, when a circuit disconnection occurs at a point of open circuit 10, a voltage is lost at the operating coil 4*b* and the diode 6*b* which are located downstream of the relevant open circuit point 10. For the sake of explanation, FIG. 1 depicts the open circuit point 10 with a downstream portion therefrom shown by broken lines indicating that the voltage is lost. Upon detecting this voltage loss, the voltage detector 9 senses that the detected voltage differs from the specified value and transmits the anomaly detection signal in the form of an alarm, for example, on the assumption that an abnormal situation has occurred. In addition, the voltage detector 9 transmits a signal for locking operation for preventing incomplete opening or closing operation as another anomaly detection signal to the exterior (not shown) and/or the switching controller 8. A reason why the voltage loss can be detected by the voltage detector 9 in this fashion is that the provision of the diode 6*b* serves to prevent a situation where potentials of the circuits of the individual phases including the operating coils 4*a*, 4*c* in which no open circuit has occurred become equal to a potential of the circuit of the phase including the operating coil 4*b* in which the open circuit has occurred. This arrangement makes it possible to detect the open circuit at the open circuit point 10.

Anomalies that can be detected include a situation in which "an open circuit has occurred in an operating coil or in a circuit including the same", a situation in which "a connector in a circuit including a coil has been disconnected (loose connection)" and a situation in which "a power supply voltage has been lost". It is to be noted that disconnection of a connector has a high probability of occurrence and this anomaly is detectable.

According to the switchgear operating apparatus of the first embodiment described above, the voltage detector detects a voltage loss caused by an open circuit, for instance, by detecting potential differences applied to the individual operating coils and the electronic switching device and monitoring the voltages of the circuits of the individual phases. By detecting this kind of voltage loss, the voltage detector can transmit an alarm and a signal for locking operation for preventing incomplete opening or closing operation to the exterior (not shown) and/or the switching controller. Therefore, it is possible to detect a wide range of anomalies caused by a circuit disconnection, for example.

Also, it is possible to supply power for driving the voltage detector from the capacitor. In this case, it is not necessary to provide an extra driving power supply.

The present invention is applicable similarly to switchgear operating apparatuses not only for circuit breakers like VCB or GCB but also for switchgears which are directly driven by operating coils, thus generating like advantageous effects.

The invention claimed is:

1. A switchgear operating apparatus provided with switching means having a first end connected to a negative electrode side of a DC power supply and a plurality of operating coils, which are is simultaneously energized and controlled by said switching means for performing on/off operations of a switchgear, said operating coils each having a first end connected to a positive electrode side of the DC power supply and a second end connected to a second end of said switching means, said switchgear operating apparatus comprising:

rectifying devices respectively connected in series between said operating coils and said switching means, the forward direction of said rectifying devices being a direction from said operating coils to said switching means; and detection means for detecting a potential difference applied between a positive side of each rectifying device and said first end of said switching means.

2. The switchgear operating apparatus as recited in claim 1, wherein an anomaly detection signal is output when any of the potential differences detected by said detection means differs from a specified value.

3. A three-phase switchgear of which on/off operations are performed by a switchgear operating apparatus provided with a switching section having a first end connected to a negative electrode side of a DC power supply and a plurality of operating coils which are simultaneously energized and controlled by said switching section, said operating coils each having a first end connected to a positive electrode side of the DC power supply and a second end connected to a second end of said switching section, said switchgear operating apparatus comprising:

rectifying devices connected in series between said individual operating coils and said switching means; and a detecting section for detecting a potential difference applied between a positive side of each rectifying device and said first end of said switching section.

4. The three-phase switchgear as recited in claim 3, wherein said switchgear operating apparatus outputs an anomaly detection signal when any of the potential differences detected by said detecting section differs from a specified value.

5. The switchgear operating apparatus as recited in claim 1, wherein the detection means for detecting potential differences transmits a signal for locking operation for preventing an incomplete opening operation or an incomplete closing operation of the switchgear.

6. The switchgear operating apparatus as recited in claim 1, wherein the detection means comprises a voltage detector.

7. The switchgear operating apparatus as recited in claim 6, wherein the voltage detector is supplied power via a capacitor.

8. The switchgear operating apparatus as recited in claim 7, wherein the capacitor is connected to the switching means.

9. The switchgear operating apparatus as recited in claim 1, wherein the rectifying device comprises a diode connected between the operating coil and the switching means and wherein the detection means is connected to an anode of the diode.

10. The switchgear operating apparatus as recited in claim 3, wherein the detection means for detecting potential differences transmits a signal for a locking operation to prevent an incomplete opening operation or an incomplete closing operation of the switchgear.

11. The switchgear operating apparatus as recited in claim 10, wherein said switching means comprises a switching controller and wherein the detection means for detecting potential differences transmits the signal for the locking operation to the switching controller.

12. The switchgear operating apparatus as recited in claim 3, wherein detection means comprises a voltage detector.

13. The switchgear operating apparatus as recited in claim 12, wherein the voltage detector is supplied power via a capacitor.

14. The switchgear operating apparatus as recited in claim 13, wherein the capacitor is connected to the switching means.

15. The switchgear operating apparatus as recited in claim 3, each of the rectifying devices comprises a diode connected in series between each individual operating coil and the switching means and wherein the detection section is connected to an anode of the diode of each of the rectifying devices.

* * * * *